United States Patent [19]

Gockel

[11] 4,052,966

[45] Oct. 11, 1977

[54] PROCESS FOR THE CONTROL OF OXIDES OF NITROGEN FROM INTERNAL COMBUSTION ENGINES

[75] Inventor: Jack L. Gockel, Montebello, Calif.

[73] Assignee: Air Quality Products, Inc., Orange, Calif.

[21] Appl. No.: 341,503

[22] Filed: Mar. 15, 1973

[51] Int. Cl.[2] ..... F02P 5/04

[52] U.S. Cl. ..... 123/117 A; 123/117 R

[58] Field of Search ..... 123/117 A, 117 R, 146.5 A

[56] References Cited

U.S. PATENT DOCUMENTS

| | | | |
|---|---|---|---|
| 2,027,507 | 1/1936 | Arthur | 123/117 A |
| 3,385,275 | 5/1968 | Burnia et al. | 123/117 A |
| 3,515,368 | 6/1970 | Kelly | 123/117 A X |
| 3,584,521 | 6/1971 | Tooker et al. | 123/117 A X |
| 3,800,767 | 4/1974 | Winkley | 123/117 A X |
| 3,895,616 | 7/1975 | Steinke | 123/117 A |

*Primary Examiner*—Carroll B. Dority, Jr.
*Assistant Examiner*—Tony M. Argenbright
*Attorney, Agent, or Firm*—Knobbe, Martens, Olson, Hubbard & Bear

[57] ABSTRACT

An improved process for the control of oxides of nitrogen in engine exhaust gases by retarding the spark timing according to a specific procedure producing extraordinary reductions without adverse driveability effects. The process involves the retarding of spark timing by (1) adjusting the basic timing and (2) disconnecting the vacuum advance mechanism of the ignition distributor.

4 Claims, 4 Drawing Figures

PROCESS FOR THE CONTROL OF OXIDES OF NITROGEN FROM INTERNAL COMBUSTION ENGINES

BACKGROUND OF THE INVENTION

The invention relates to an imporved process of controlling the nitrogen oxide emission from internal combustion engines by retarding spark timing. It is known that retarded spark timing decreases the time for nitrogen to react with oxygen in the combustion chamber at high temperatures and pressures to form nitrogen oxide. A study on 200 cars[1] for the California Air Resources Board on the effects of disconnection of the vacuum spark advance mechanism of 1966 through 1970 vehicles showed that a 38% reduction of oxides of nitrogen ($NO_x$) could be attained.

(1) California Air Resources Board Staff Report, Testing Vacuum Spark Advance Disconnect (VSAD) under the Applied Research Program, SB848,Nov. 8, 1972.

Automobile manufacturers have used delayed spark advance for the control of $NO_x$ on 1971 and later vehicles to meet California and Federal new car emission standards. California has passed legislation for the mandatory retrofit of used vehicles for devices meeting approval by the California Air Resources Board. To date, two devices using spark timing have been approved providing 41.6% and 44.7% reductions.

DESCRIPTION OF INVENTION

Figure 1:
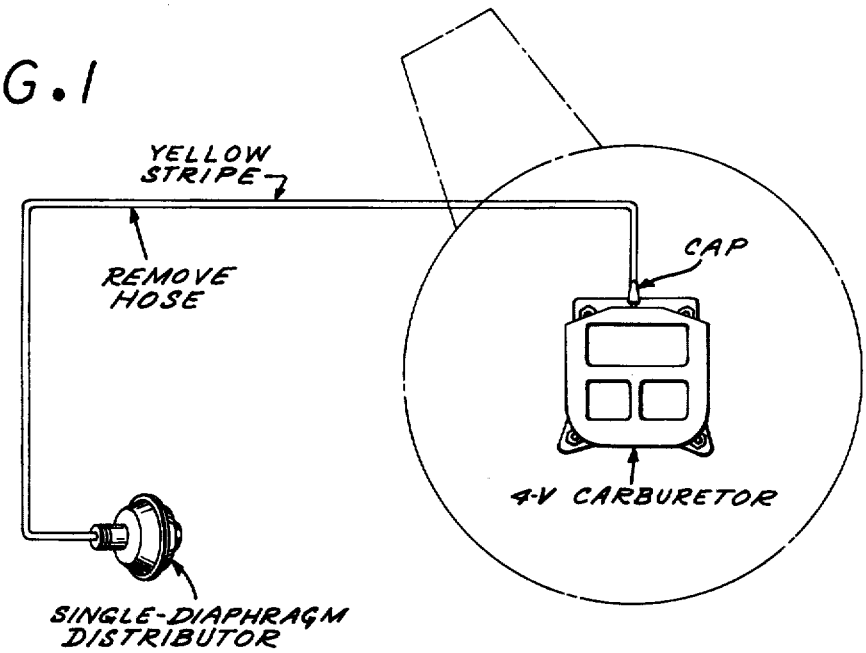
FIG. 1 is a schematic illustration of a first embodiment of the invention for a single diaphragm distributor.
Figure 2:
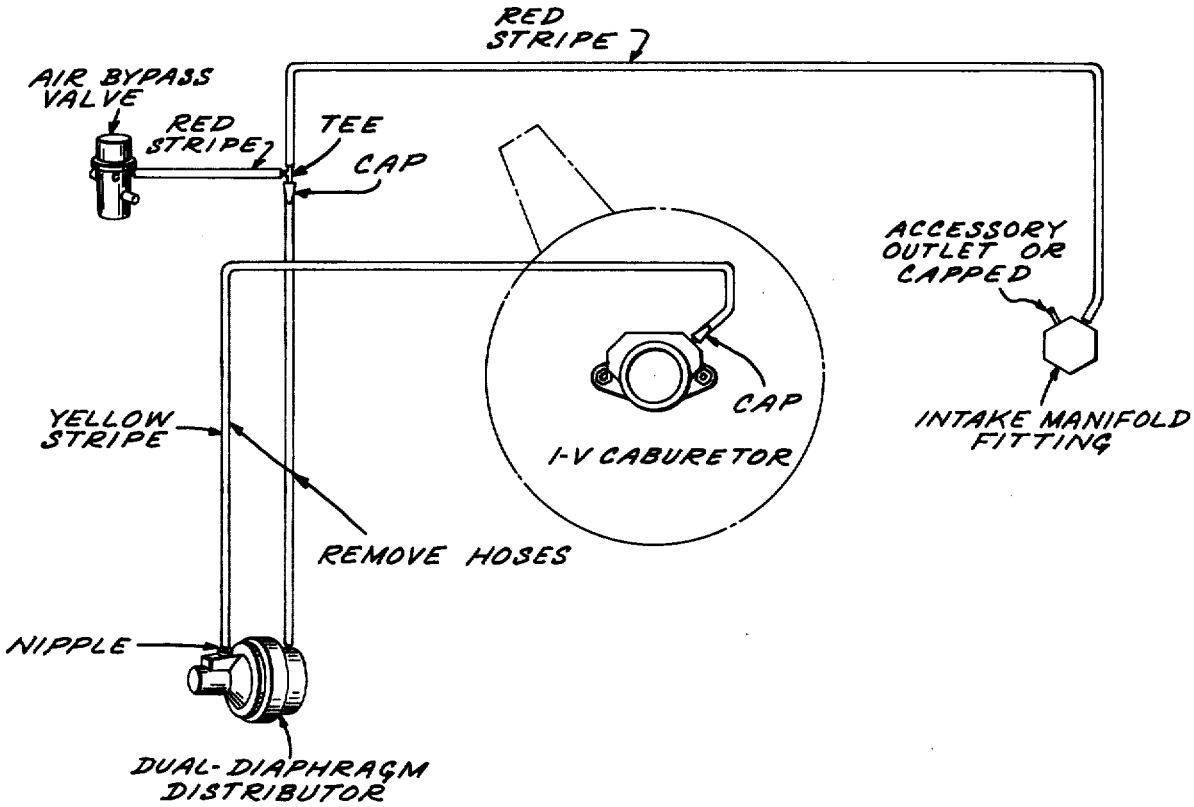
FIG. 2 is a schematic illustration of a second embodiment of the invention for a dual diaphragm distributor.
Figure 3:
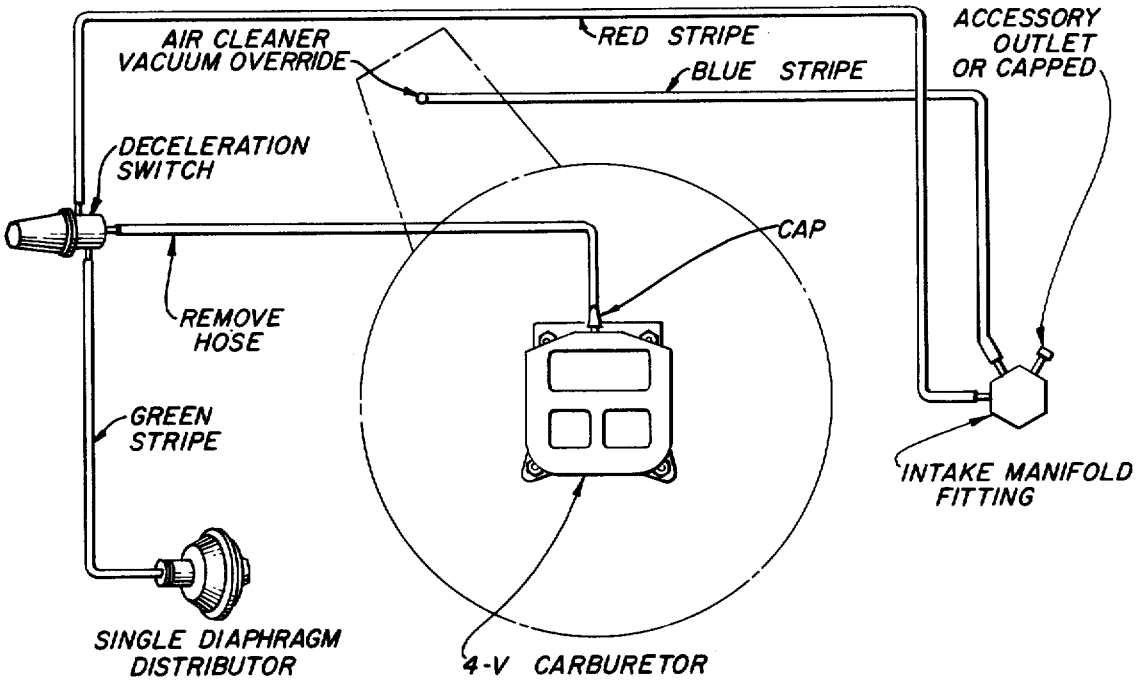
FIG. 3 is a schematic illustration of a third embodiment of the invention for a single diaphragm distributor with a deceleration switch.
Figure 4:
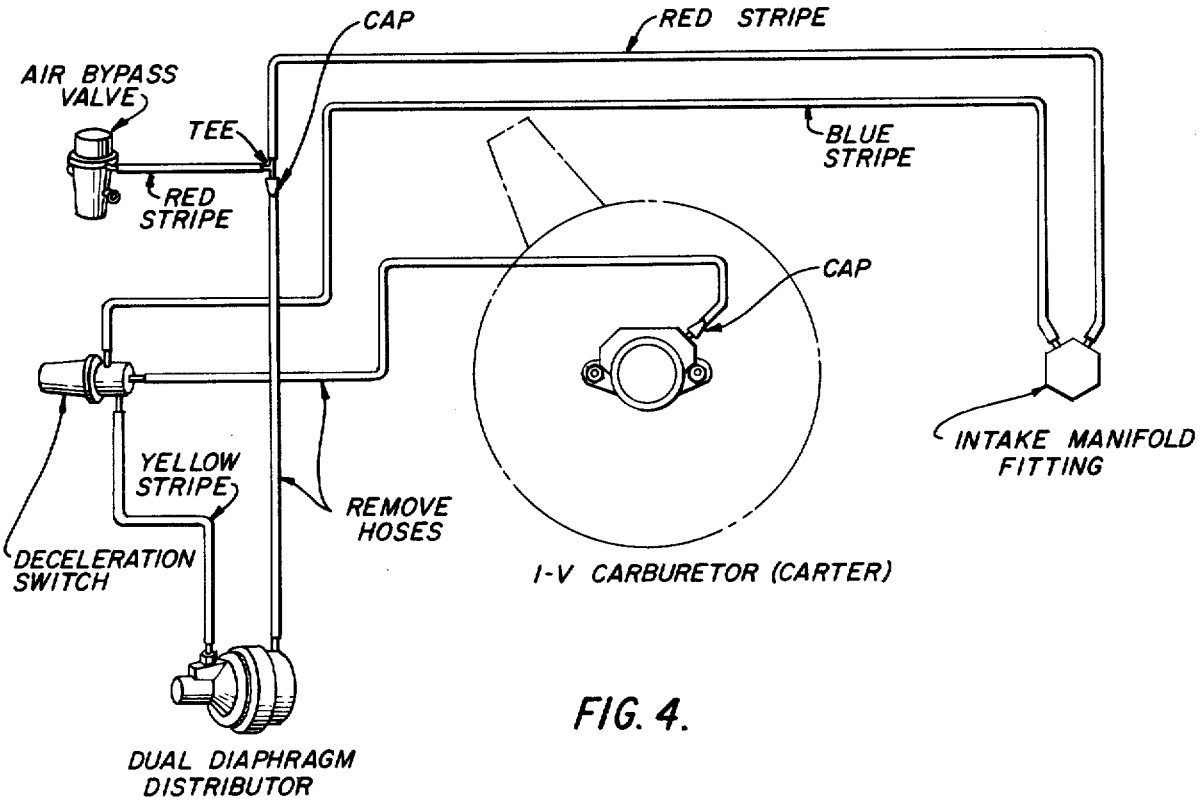
FIG. 4 is a schematic illustration of a fourth embodiment of the invention for a dual diaphragm distributor with a deceleration switch.

This invention is a process for modifying and adjusting an engine to provide the maximum control of $NO_x$ without adversely affecting the driveability of the vehicle. The process involves adjusting the basic timing of an engine according to the following procedure Adjust timing at an idle speed recommended by the engine manufacturer.

Set at 1° before top dead center (BTC) on all engines except those where the manufacturer's specified setting is a. more retarded than 1° BTC——then set at the manufacturer's specifications for these engines;

b. more advanced than 7.5° BTC——then set at one-half of the manufacturer's specifications for these engines.

b. more advanced than 7.5°BTC——then set at one-half of the manufacturer's specifications for these engines.

The process also involves the disconnection of the vacuum spark advance mechanism of the ignition distributor. The disconnection procedure depends upon the type of vacuum advance system used for the engine.

Engines have single and dual diaphragm distributors and are equipped with and without deceleration switches. The deceleration switches are provided to reinstate the vacuum spark advance when the engine is under deceleration conditions. This prevents backfiring in the exhaust system. Instructions for the four different types of vacuum advance systems are as follows:

TYPE I — SINGLE DIAPHRAGM DISTRIBUTORS WITH NO DECELERATION SWITCHES (FIG. 1)

1. Remove and dispose of vacuum hose connected to the distributor.
2. Cap off the vacuum source where the hose was previously connected.

TYPE II — DUAL DIAPHRAGM DISTRIBUTORS WITH NO DECELERATION SWITCHES (FIG. 2)

1. Remove and dispose of the two vacuum hoses connected to the distributor.
2. Cap off the vacuum sources where the hoses were previously connected.

TYPE III — SINGLE DIAPHRAGM DISTRIBUTORS WITH DECELERATION SWITCHES (FIG. 3)

1. Remove and dispose of the vacuum hose connected between the carburetor and the deceleration switch.
2. Cap off the source of vacuum at the carburetor. Do not cap off opening into deceleration valve.
3. Do not disturb the vacuum hose between deceleration valve and the distributor or the hose between the deceleration valve and the intake manifold vacuum source.

TYPE IV — DUAL DIAPHRAGM DISTRIBUTORS WITH DECELERATION SWITCHES (FIG. 4)

1. Remove and dispose of the vacuum hose between the carburetor and deceleration switch.
2. Cap off vacuum source at carburetor.
3. Remove and dispose of the vacuum hose between the secondary diaphragm of the distributor and intake manifold vacuum.
4. Cap off manifold vacuum source.

Emission and driveability tests were performed on a fleet of 10 vehicles to determine the effectiveness of the above process. Emission tests were run by Scott Research Laboratories in San Bernardino, Cal., according to the 1972 Federal test procedure.

Tests were run on these vehicles with engines adjusted to manufacturer's specifications, and again after they were modified and adjusted according to the invented process. Driveability tests were also performed. The results of the emission tests are shown in Table I.

It is demonstrated that the invented process reduces $NO_x$ by 54% and unburned hydrocarbons (HC) by 21.8%. Carbon monoxide (CO) emissions were unchanged. Road test results showed an insignificant change in driveability.

The above data shows that the process invented, providing a 54% reduction in $NO_x$ without adverse effects on driveability, is extraordinary and beyond what is obvious.

TABLE I

TEST FLEET DESCRIPTION AND TEST DATA

| YEAR | MAKE | ENGINE DISPLACEMENT | TYPE OF DISTRIBUTOR | DECEL. SWITCH | EMISSIONS BY 1972 FEDERAL TEST PROCEDURE (HOT) GRAMS/MILE | | | | | |
|---|---|---|---|---|---|---|---|---|---|---|
| | | | | | PER MFGR'S SPECS. | | | ADJUST. & MOD. PROCESS | | |
| | | | | | NOX | CO | HC | NOX | CO | HC |
| 1969 | Mercury | 302 | Single | No | 9.15 | 37.8 | 4.23 | 4.87 | 39.2 | 3.41 |
| 1966 | Dodge | 225 | Single | Yes | 3.96 | 45.7 | 2.77 | 2.82 | 49.5 | 2.91 |
| 1966 | Rambler | 232 | Single | No | 3.99 | 27.8 | 2.12 | 2.60 | 27.3 | 1.67 |
| 1969 | Cadillac | 472 | Single | No | 9.94 | 20.1 | 2.50 | 4.21 | 19.4 | 1.26 |
| 1969 | Ford | 429 | Dual | No | 5.89 | 78.5 | 3.61 | 1.92 | 82.9 | 2.94 |
| 1970 | Plymouth | 318 | Single | No | 4.01 | 57.1 | 3.62 | 2.40 | 59.5 | 3.18 |
| 1966 | Plymouth | 273 | Single | Yes | 3.75 | 35.8 | 4.35 | 1.64 | 35.2 | 3.48 |
| 1966 | Chevrolet | 283 | Single | No | 5.03 | 31.4 | 2.85 | 1.92 | 28.3 | 1.92 |
| 1969 | Ford | 170 | Single | No | 4.57 | 18.7 | 2.38 | 1.79 | 17.1 | 1.57 |
| 1970 | Maverick | 200 | Dual | No | 7.20 | 18.7 | 2.21 | 2.27 | 18.0 | 1.59 |
| | | | | AVERAGE | 5.75 | 37.2 | 3.06 | 2.64 | 37.6 | 2.39 |

REDUCTIONS:
NOX = 54%
CO = NO CHANGE

I claim:

1. An improved method for reducing $NO_x$ emissions on American manufactured automobiles made before 1970 and which include a system for vacuum advance of ignition, and a single diaphragm distributor, directly connected by a vacuum hose to a carburetor vacuum source outlet without any intermediate deceleration switch, comprising:

permanently disconnecting the vacuum hose between the carburetor and the distributor;

permanently capping off the vacuum source outlet at the carburetor;

determining the automobile manufacturer's recommended timing setting; and adjusting the timing of the engine when operating at the speed recommended by the manufacturer according to the following procedure:

if the manufacturer's recommended timing setting is more retarded than about one degree before top dead center, set the timing at about the manufacturer's recommended setting;

if the manufacturer's recommended timing setting is one degree before top dead center, to about 7.5° before top dead center, set the timing at about 1° before top dead center; and if the manufacturer's recommended timing setting is more advanced than about 7.5° before top dead center, set the timing at about one-half of the advance recommended by the manufacturer.

2. An improved method for reducing $NO_x$ emissions on American manufactured automobiles made between the years 1966 and 1970 which include a system for vacuum advance of ignition and a dual diaphragm distributor having a pair of vacuum hoses connected from opposite ends of the dual diaphragm distributor, one hose being directly connected to a carburetor vacuum source, and the other hose being connected to an intake manifold vacuum source, comprising:

permanently disconnecting both of said vacuum hoses connected to the distributor;

permanently capping off both of the vacuum sources where the hoses were previously connected;

determining the automobile manufacturer's recommended timing setting; and adjusting the timing of the engine when operating at the speed recommended by the manufacturer according to the following procedure:

if the manufacturer's recommended timing setting is more retarded than about one degree before top dead center, set the timing at about the manufacturer's recommended setting;

if the manufacturer's recommended timing setting is one degree before top dead center to about 7.5° before top dead center, set the timing at about 1° before top dead center; and if the manufacturer's recommended timing setting is more advanced than about 7.5° before top dead center, set the timing at about one-half of the advance recommended by the manufacturer.

3. An improved method for reducing $NO_x$ emissions on American manufactured automobiles made between the years 1966 and 1970 which include a system for the vacuum advance of ignition, a single diaphragm distributor, a deceleration switch, and a vacuum hose connected from the distributor to the deceleration switch and from the deceleration switch to a carburetor vacuum source comprising:

permanently disconnecting the vacuum hose connected between the carburetor and the deceleration switch;

permanently capping off the source of vacuum at the carburetor, leaving open the opening into the deceleration switch from which the vacuum hose was removed;

leaving in place the vacuum hose between the decelerartion switch and the distributor;

determining the automobile manufacturer's recommended timing setting; and adjusting the timing of the engine when operating at the speed recommended by the manufacturer according to the following procedure:

if the manufacturer's recommended timing setting is more retarded than about one degree before top dead center, set the timing at about the manufacturer's recommended setting;

if the manufacturer's recommended timing setting is one degree before top dead center to about 7.5° before top dead center, set the timing at about one degree before top dead center; and if the manufacturer's recommended timing setting is more advanced than about 7.5° before top dead center, set the timing at about one-half of the advance recommended by the manufacturer.

4. An improved method for reducing $NO_x$ emissions on American manufactured automobiles made between the years 1966 and 1970 which include a system for vacuum advance of the ignition, a dual diaphragm distributor, a deceleration switch, and two vacuum hoses connected to opposite ends of the distributor, one of which is connected to the deceleration switch and the other of which is connected to an intake manifold vacuum source, and a third vacuum hose connected between the deceleration switch and a carburetor vacuum source comprising:

permanently disconnecting the vacuum hose between the carburetor and the deceleration switch;

permanently capping off the vacuum source at the carburetor leaving open the opening into the deceleration switch from where the vacuum hose was removed;

permanently disconnecting the vacuum hose between the distributor and the intake manifold;

permanently capping off the vacuum source to the manifold from which the hose was removed;

determining the automobile manufcturer's recommended timing setting; and adjusting the timing of the engine when operating at the speed recommended by the manufacturer according to the following procedure:

if the manufacturer's recommended timing setting is more retarded than about one degree before top dead center, set the timing at about the manufacturer's recommended setting;

if the manufacturer's recommended timing setting is about 1° before top dead center to about 7.5° before top dead center, set the timing at about 1° before top dead center; and if the manufacturer's recommended timing setting is more advanced than about 7.5° before top dead center, set the timing at about one-half of the advance recommended by the manufacturer.

* * * * *